US005743155A

United States Patent [19]

Tortul

[11] Patent Number: 5,743,155

[45] Date of Patent: Apr. 28, 1998

[54] MECHANICAL DEVICE FOR CHANGING THE PHASE RELATIONSHIP BETWEEN THE ENGINE SHAFT AND A CAMSHAFT OF AN INTERNAL COMBUSTION ENGINE

[75] Inventor: Renzo Tortul, San Pier D'Isonzo, Italy

[73] Assignee: Carraro S. p. A., Padova, Italy

[21] Appl. No.: 644,192

[22] Filed: May 10, 1996

[30] Foreign Application Priority Data

May 11, 1995 [IT] Italy ..... PD95A0094

[51] Int. Cl.[6] ..... F16H 53/00

[52] U.S. Cl. ..... 74/568 R; 123/90.17

[58] Field of Search ..... 74/568 R, 567; 123/90.12–90.31; 464/1, 2, 160

[56] References Cited

U.S. PATENT DOCUMENTS

| | | | |
|---|---|---|---|
| 5,067,450 | 11/1991 | Kano et al. | 123/90.17 |
| 5,088,456 | 2/1992 | Suga | 123/90.17 |
| 5,144,921 | 9/1992 | Clos et al. | 123/90.17 |
| 5,170,756 | 12/1992 | Szodfridt | 123/90.17 |
| 5,197,421 | 3/1993 | Hara | 123/90.17 |
| 5,301,639 | 4/1994 | Satou | 123/90.17 |
| 5,329,890 | 7/1994 | Mueller | 123/90.17 |
| 5,381,764 | 1/1995 | Fukuma et al. | 74/568 R X |
| 5,474,038 | 12/1995 | Golovatai-Schmidt et al. | 74/568 R |

*Primary Examiner*—Vinh T. Luong

*Attorney, Agent, or Firm*—Sughrue, Mion, Zinn, Macpeak & Seas, PLLC

[57] ABSTRACT

In a mechanical device for changing the phase relationship between the engine shaft and a camshaft of an internal combustion engine, in which the phase change is achieved by a change in the angular position of a body kinematically connected to the engine shaft relative to that of a shaft kinematically connected to the camshaft by the movement of a piston and of an auxiliary annular element which are spaced apart axially and are interposed between the body and the shaft to which they are coupled by intermeshing teeth, a stop is provided for limiting the axial travel of the auxiliary annular element, advantageously stopping the piston owing to engagement in the teeth of the shaft and of the body.

15 Claims, 5 Drawing Sheets

MECHANICAL DEVICE FOR CHANGING THE PHASE RELATIONSHIP BETWEEN THE ENGINE SHAFT AND A CAMSHAFT OF AN INTERNAL COMBUSTION ENGINE

BACKGROUND OF THE INVENTION

The present invention relates to a mechanical device for changing the phase relationship between the engine shaft and a camshaft of an internal combustion engine, of the type comprising a first component and a second component coaxial with one another and connected kinematically to the engine shaft and to the camshaft, respectively, and a piston-like member interposed between the components and having two sets of teeth of which one has an angle of twist relative to the other, and which are meshed with a set of teeth of the first component and with a set of teeth of the second component, respectively, the piston-like member moving relative to the components under the action of a pressurized fluid regulated by a valve controlled by an electronic engine-management unit so as to change the relative angular positions of the first component and of the second component and the phase relationship between the engine shaft and the camshaft.

As is known, mechanical devices of the type described above enable the operation of internal combustion engines to be optimized in the various conditions of load and/or rate of revolution.

However, these devices may have the disadvantage of generating a certain amount of noise. In fact, with reference to conventional timing with valves and return springs, noise generated during the operation of the aforementioned devices is caused by the continuous relative movement between the meshed teeth as a result of the continuous reversal of the load reacting on the camshaft due to the dynamics of the timing system.

Moreover, the achievement of perfect meshing between the teeth in order to eliminate the play between them is structurally very difficult and expensive and hence impracticable.

A solution proposed to avoid this problem provides for the piston-like member to be divided into two parts between which there is a misalignment in the consecutive portions of the sets of teeth so that, with a suitable resilient load between these portions, the play between the sets of teeth is taken up.

This solution has the disadvantage that there is always friction between the sides of the teeth of the piston-like member and of the components, due to the resilient load applied. This friction obstructs the movement of the piston-like member which brings about the relative angular displacement between the two components, increasing the time necessary to change the angular phase relationship between the engine shaft and the camshaft.

SUMMARY OF THE INVENTION

The object of the present invention is to devise a mechanical device for varying the phase relationship between the engine shaft and a camshaft of an internal combustion engine which has structural and functional characteristics such as to overcome the disadvantages mentioned with reference to the prior art.

This object is achieved by means of a mechanical device for changing the phase relationship between the engine shaft and a camshaft of an internal combustion engine, of the type comprising a first component and a second component coaxial with one another and connected kinematically to the engine shaft and to the camshaft, respectively, and a piston-like member interposed between the components and having two sets of teeth of which one has an angle of twist relative to the other, and which are meshed with a set of teeth of the first component and with a set of teeth of the second component, respectively, the piston-like member moving relative to the components under the action of a pressurized fluid so as to change the relative angular positions of the first component and of the second component and the phase relationship between the engine shaft and the camshaft, characterized in that it comprises an auxiliary annular element interposed between the components at a predetermined distance from the piston-like member and having two sets of teeth meshed with the teeth of the first component and with the teeth of the second component, respectively, and stop means which limit the travel of the auxiliary annular element, preventing relative rotation between the components and stopping the piston-like member owing to engagement in the teeth of the components.

BRIEF DESCRIPTION OF THE INVENTION

Further characteristics and the advantages of the mechanical device according to the present invention will become clear from the following description of some embodiments thereof given by way of non-limiting example, with reference to the appended drawings, in which:

FIG. 1 is a schematic, cross-sectional view of a mechanical device according to the present invention, FIG. 2 is a schematic, cross-sectional view of the device of FIG. 1 at a stage in its operation, FIGS. 3 to 5 show variants of a detail of the device of FIG. 1, and FIGS. 6 and 7 are schematic sectional views of two variants of a mechanical device according to the present invention.

DETAILED DESCRIPTION OF THE INVENTION

Figure 1:
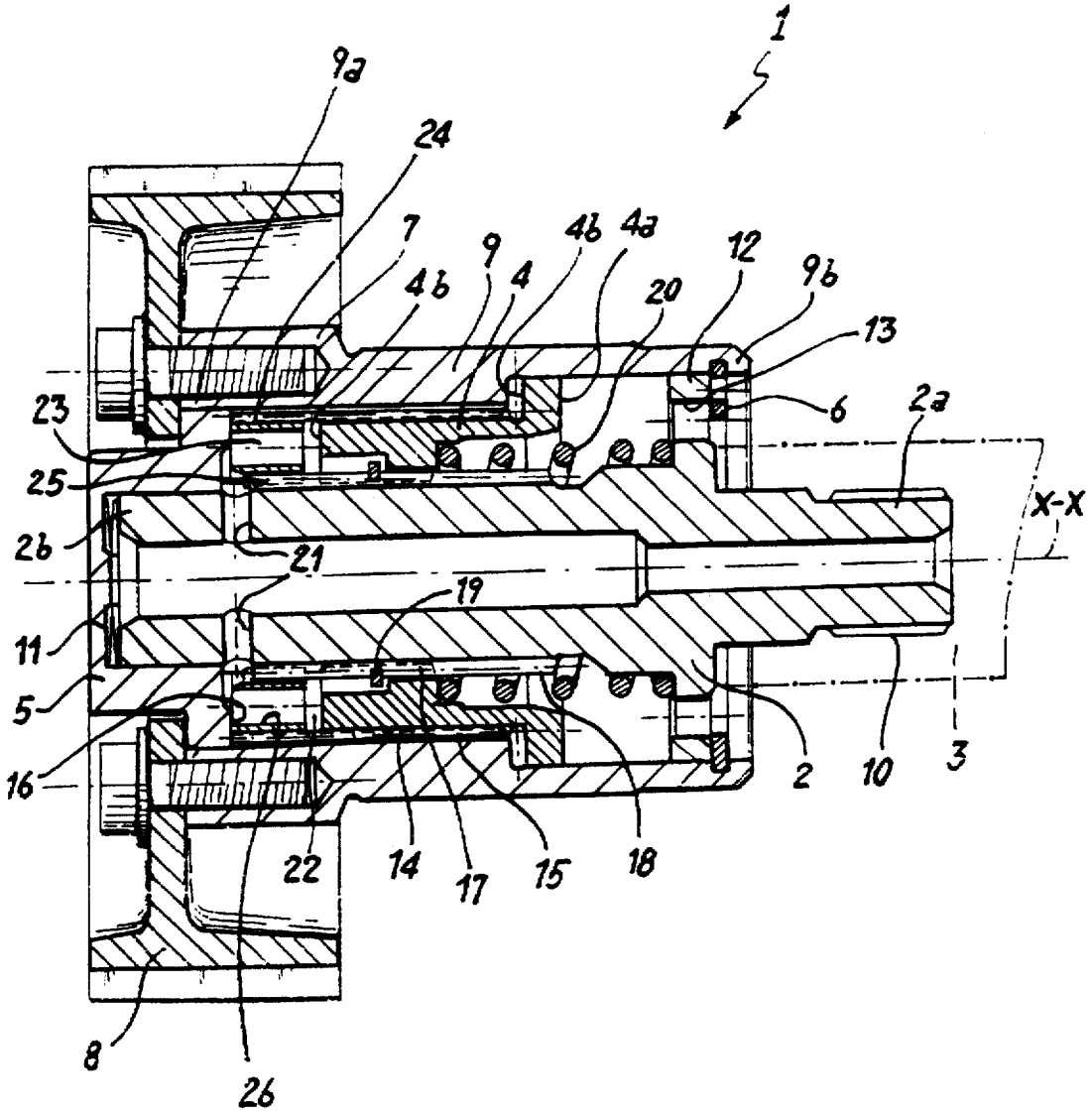
Figure 2:
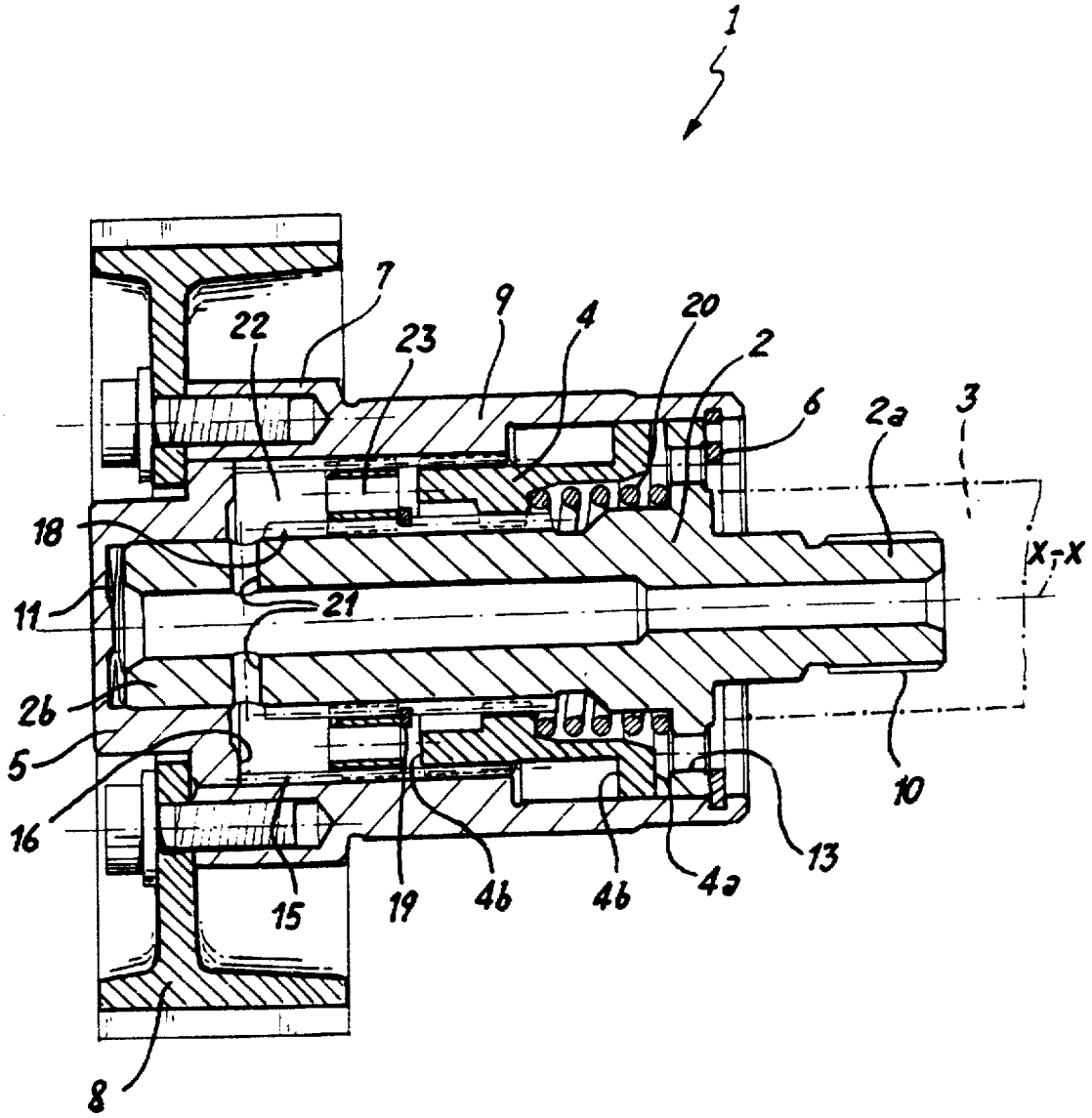

With reference to FIGS. 1 and 2, a mechanical device according to the invention for changing the phase relationship between the engine shaft and a camshaft 3, shown in chain line in the drawing, of an internal combustion engine, is generally indicated 1.

The mechanical device 1 comprises a first component constituted by a hollow annular body 9, a second component constituted by a hollow shaft 2 supported coaxially for rotation in the body 9, and an annular piston-like member 4 interposed between the body 9 and the shaft 2 and also coaxial therewith.

The body 9, of axis X—X, has a cover 5 laser-welded to the body 9 at a first end 9*a* and an internal peripheral seat housing an abutment ring 6 at the opposite end 9*b*. A gear 8, fixed to a flange 7 of the body 9 by means of screws, is connected kinematically to the engine shaft by means of a toothed belt, not shown in the drawings.

One end 2*a* of the hollow shaft 2 has a threaded shank 10 fixed by a male/female screw coupling to the camshaft 3 which, in known manner, operates spring-returned valves of the internal combustion engine. Belleville washers 11 interposed axially between the cover 5 and the end 2*b* of the shaft 2 urge a flange 12 of the shaft 2, containing a plurality of holes 13, resiliently into abutment with the abutment ring 6.

The annular piston 4 comprises an external set of helical teeth 14 meshed with a corresponding internal set of teeth 15 of the body 9. Internally, the piston 4 comprises a set of teeth 17 which are preferably straight and are meshed with a corresponding external set of teeth 18 of the shaft 2.

A cylindrical helical spring 20 is mounted coaxially with the shaft 2 between the flange 12 and a first frontal surface 4*a* of the piston 4 on which the spring 20 acts with a predetermined axial force.

Ducts 21 in the shaft 2 put the cavity of the shaft 2 into fluid communication with an annular chamber 22 which is defined radially by the body 9 and by the body 2 and axially by the cover 5 and by a second frontal surface 4*b* of the piston 4.

The mechanical device 1 comprises an auxiliary annular element 23 interposed coaxially between the body 9 and the shaft 2 and, like the piston 4, having an external set of helical teeth 24 meshed with the corresponding internal set of teeth 15 of the body 9 and an internal set of straight teeth 25 meshed with the corresponding set of teeth 18 of the shaft 2. The auxiliary annular element 23 is positioned axially between the cover 5 and the piston 4 at a predetermined distance from the latter. The auxiliary annular element 23 has a plurality of axial holes 26 arranged at intervals peripherally.

The mechanical device 1 comprises stop means which limit the axial travel of the auxiliary annular element 23. These means preferably comprise a first abutment defined by an axial shoulder 16 of the cover 5 which is inside the body 9 and which the auxiliary annular element 23 abuts in a first travel limit position, and a second abutment constituted by an abutment ring 19 which is housed in a peripheral seat in the shaft 2 and which the auxiliary annular element 23 abuts in a second travel limit position.

Figure 3:
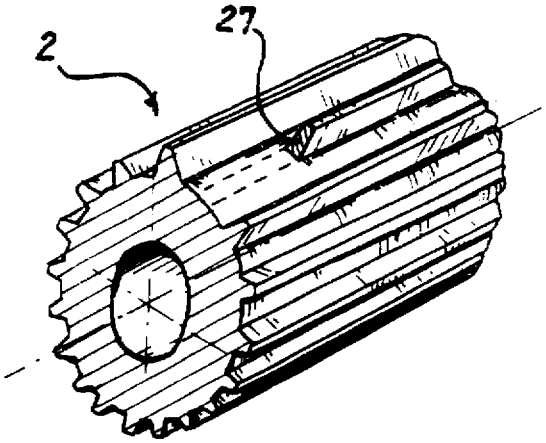

Alternatively, the second abutment may be constituted at least by a step 27 formed by the removal of a portion of the set of straight teeth 18 of the shaft 2 and interfering with a solid cross-sectioned portion of the set of teeth of the auxiliary annular element 23, the solid cross-sectioned portion being slidable in the portion of the shaft 2 without teeth (FIG. 3).

Figure 4:
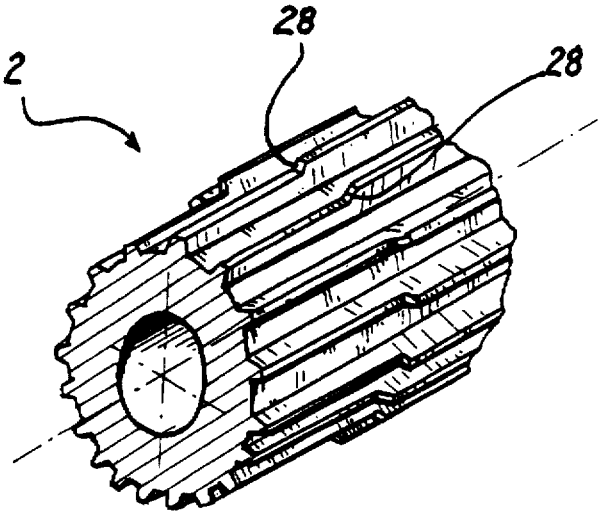
Figure 5:
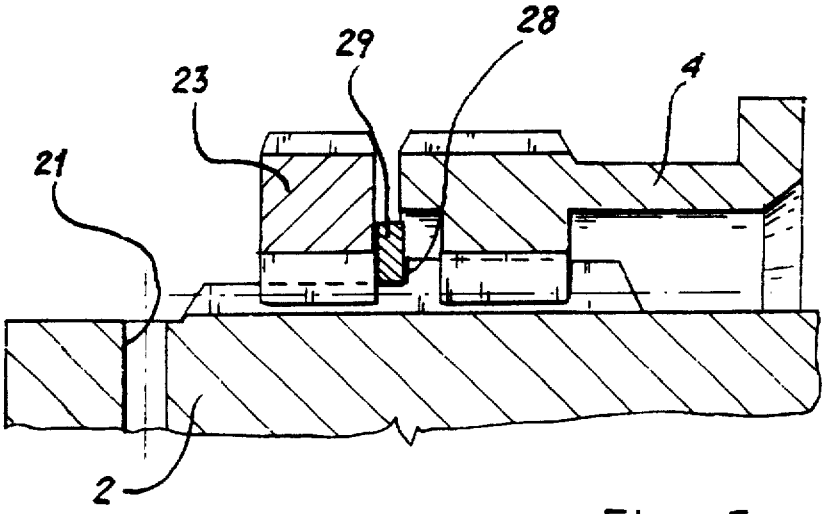

Alternatively, the second abutment may be constituted by a step 28 (FIG. 4) formed on the set of straight teeth 18 of the shaft 2 and abutted by the auxiliary annular element 23, of which the outside diameter of the internal set of straight teeth 25 is recessed relative to the step 28. The auxiliary annular element 23 can be stopped by the interposition of an abutment ring 29 between the step 28 and the auxiliary annular element 23 (FIG. 5).

When the mechanical device 1 is in operation, axial sliding of the piston 4 on the set of straight teeth 18 of the shaft 2 corresponds to rotation of the body 9 relative to the shaft 2 owing to the helical toothed coupling between the piston 4 and the body 9. This relative rotation in turn brings about axial sliding of the auxiliary annular element 23 on the set of straight teeth 18 of the shaft 2. This sliding is equal to that of the piston 4 since the annular element is also meshed with the helical teeth 15 of the body 9.

The action of the spring 20 on the piston 4 causes the piston 4, and hence also the auxiliary annular element 23, to slide towards the cover 5 on the straight teeth 18 of the shaft 23. This sliding brings the auxiliary annular element 23 into abutment with the shoulder 16 in the aforementioned first travel limit position (FIG. 1). The stopping of the auxiliary annular element 23 locks the relative rotation between the body 9 and the shaft 2 and stops the piston 4 by virtue of engagement in the teeth 15 and 18. It is appropriate to underline that the stopping of the piston 4 by wedging in the teeth 15 and 18 owing to the action exerted by the spring 20 thereon, even when relative rotation between the body 9 and the shaft 2 is prevented, enables the meshed teeth to be kept in close contact, eliminating the continuous movement to and fro which takes place between them as a result of the continuous reversal of the load reacting on the camshaft due to the dynamics of the timing system mentioned in the introduction, rendering the mechanical device 1 noiseless.

In order to change the timing, for example, to advance the opening of the valves, pressurized fluid is sent into the cavity of the shaft 2 upon the command of an electronic engine-management unit and by means of a suitable solenoid valve of known type, not shown. The pressurized fluid flows through the ducts 21 and the holes 26 in the auxiliary annular element 23 into the annular chamber 22 and, acting in opposition to the spring 20, brings about sliding of the piston 4 and of the auxiliary annular element 23 on the straight teeth 18. This sliding brings the auxiliary annular element 23 into abutment with the abutment ring 19 in the second travel limit position (FIG. 2). In this condition also, the stopping of the piston 4 with wedging in the teeth 15 and 18 owing to the action exerted by the fluid thereon, even when the relative rotation between the body 9 and the shaft 2 is prevented, enables the meshed teeth to be kept in close contact, eliminating continuous movement between them.

To return to the initial timing, the ducts 21 are connected to the exhaust, upon the command of the electronic control unit and by means of the solenoid valve, so that the fluid can be discharged along them and the action of the spring 20 on the piston 4 can cause the piston 4 and the auxiliary annular element 23 to slide towards the cover 5 on the straight teeth 18 of the shaft 2. As stated above, this sliding brings the auxiliary annular element 23 into abutment with the shoulder 16 in the first travel limit position (FIG. 1) and causes the piston 4 to stop owing to engagement in the teeth 15 and 18.

The holes 13 in the flange 12 allow any oil which may leak from the chamber 2 through the piston 4 to drain from the body 9.

Advantageously, during the movement of the auxiliary annular element from the first travel limit position to the second and consequently during the movement of the piston from one engagement stop position to the other, in comparison with the solution of the prior art referred to in which the teeth remain engaged even during this movement, there is reduced friction between the meshed teeth so as to render the movement of the piston extremely fast and to reduce the time needed to change the angular phase relationship between the engine shaft and the camshaft 3.

Figure 6:
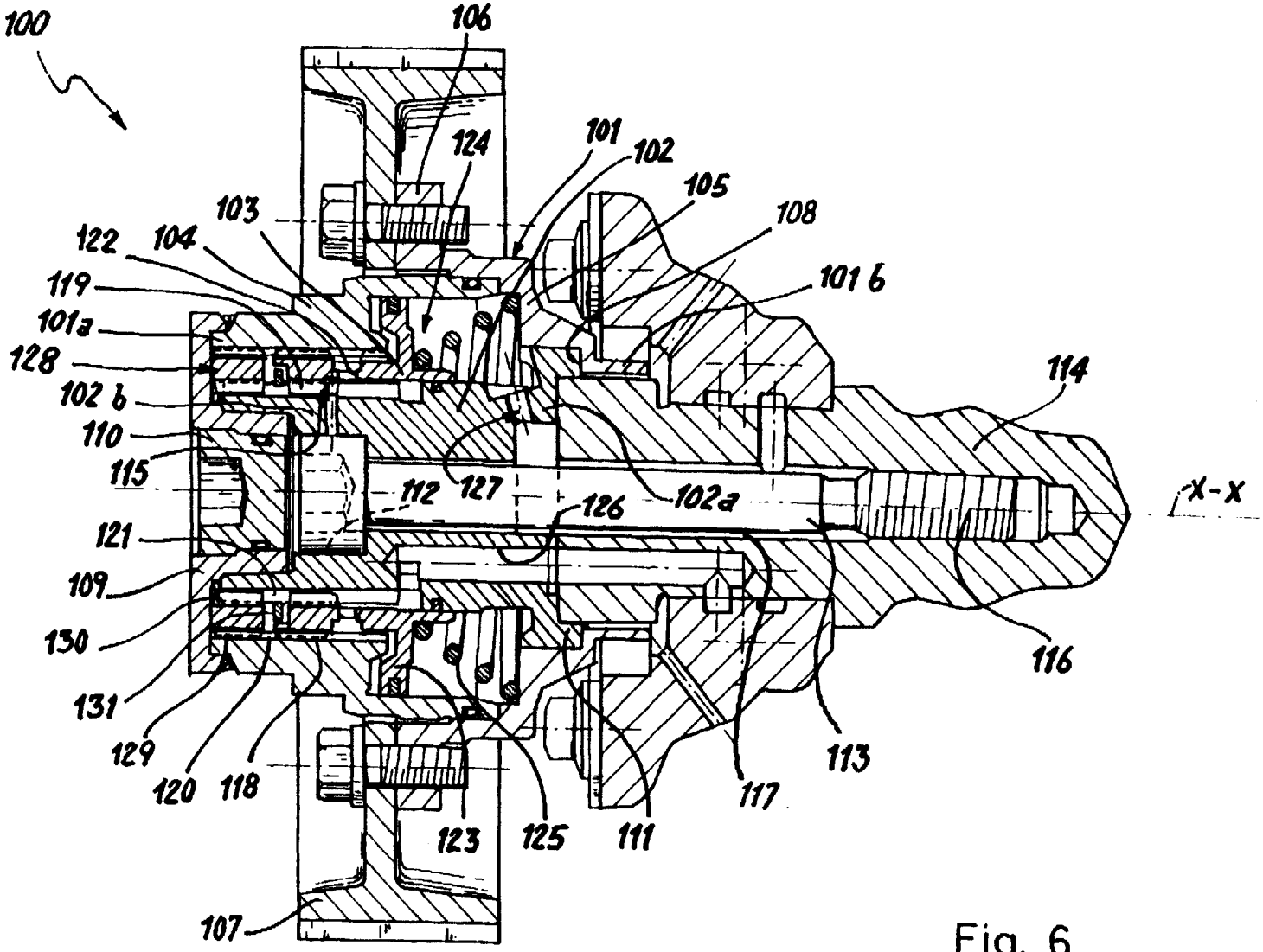

A different embodiment of a mechanical device according to the present invention, generally indicated 100, is described below with reference to FIG. 6.

The mechanical device 100 comprises a first component constituted by a hollow annular body 101, a second component constituted by a shaft 102 having a central hole and supported coaxially for rotation in the body 101, and an annular piston-like member 103 interposed between the body 101 and the shaft 102 and also coaxial therewith.

The body 101, of axis X—X, is formed by an inner half-body and an outer half-body indicated 104 and 105, respectively, and fixed together by a male/female screw coupling. A gear 107 fixed to a flange 106 of the outer half-body 105 by means of screws is kinematically connected to the engine shaft by means of a toothed belt, not shown in the drawing. The body 101 has an internal shoulder 108 at one of its ends 101*b* and a base 109 welded to the body 101 at the opposite end 101*a*. The base 109 comprises a cover 110 connected thereto by a male/female screw coupling.

A first end 102*a* of the shaft 102 comprises a flange 111 bearing against the shoulder 108, and its opposite end 102*b* bears on the base 109 of the body 101. At the end 102*b*, the central hole of the shaft 102 has a cylindrical seat 112 having an inside diameter larger than that of the hole.

A tie-rod 113 connects the shaft 102 axially to a camshaft 114 fixing them for rotation together. The tie-rod 113 comprises a rod inserted in the central hole in the shaft 102 and in a central hole of the camshaft 114, a head housed in the cylindrical seat 112 and a threaded end 116 coupled with a corresponding threaded portion of the central hole of the camshaft 114. The rod of the tie-rod 113 has a diameter smaller than that of the holes in which it is inserted so that an annular duct 117 is defined inside the camshaft 114 and the engine shaft 102.

The piston 103 comprises an external set of helical teeth 118 meshed with a corresponding internal set of teeth 120 of the inner half-body 104 and an internal set of teeth 119 which are preferably straight and are meshed with a corresponding external set of teeth 121 of the shaft 102. A plurality of radial holes 122 in the body of the piston 103 puts the inner surface of the piston 103 into fluid communication with its outer surface.

An end of the piston 103 facing towards the end 101*b* of the body 101 has a head 123 having a frontal surface with a larger diameter than the remaining portion with the helical thread 118. The head 123 constitutes an axially movable partition which divides an annular chamber 124 defined inside the mechanical device 100 by the inner half-body 104 by the outer half-body 105 and by the shaft 102 into a first half-chamber and a second half-chamber facing the base 109 and the end 101*b* of the body 101, respectively. The volumes of the half-chambers depend upon the position of the head 123 in the annular chamber 124.

A helical spring 125 coaxial with the shaft 102 and housed in the second half-chamber exerts a thrust on the head 123 of the piston 103.

A duct 126 in the shaft 102 puts the first half-chamber into fluid communication with a first hydraulic pressurized-fluid circuit of the camshaft 114 through the holes 122 in the piston 103.

A further duct 127 in the shaft 102 puts the second half-chamber into fluid communication with the annular duct 117 which in turn is in fluid communication with a second hydraulic pressurized-fluid circuit of the camshaft 114.

A solenoid valve of known type and not shown in the drawing can be controlled by an electronic control unit so as to move from a first operating position in which it puts the first hydraulic circuit into fluid communication with a main pressurized-fluid circuit of the engine and simultaneously connects the second hydraulic circuit to the exhaust, to a second operating position in which it connects the first hydraulic circuit to the exhaust and simultaneously puts the second hydraulic circuit into fluid communication with the main circuit.

The mechanical device 100 comprises an auxiliary annular element 128 interposed coaxially between the body 101 and the shaft 102 and, like the piston 103, having an external set of helical teeth 129 meshed with the corresponding teeth 120 of the inner half-body 104 and an internal set of straight teeth 130 meshed with the corresponding teeth 121 of the shaft 102. The auxiliary annular element is positioned axially between the base 109 and the piston 103 at a predetermined distance from the latter.

The auxiliary annular element 128 is movable axially between a first travel limit position in which it abuts the base 109 (FIG. 6) and a second travel limit position in which it urges an abutment ring 131 slidable on the shaft 102 into abutment with a step 115 formed on the straight teeth 121 of the shaft 102, in the same manner as described for FIG. 5.

Alternatively, the second abutment may be formed by means of one of the embodiments described for the mechanical device 1.

When the mechanical device 100 is in operation, axial sliding of the piston 103 on the straight teeth 121 of the shaft 102 corresponds to rotation of the body 101 relative to the shaft 102 due to the helical toothed coupling between the piston 103 and the body 101. This relative rotation in turn brings about axial sliding of the auxiliary annular element 128 on the straight teeth 121 of the shaft 102. This sliding is equal to that of the piston 103 since the annular element is also meshed with the helical teeth 120 of the body 101.

With reference to an initial condition in which the solenoid valve is in its second operating position and in which the action exerted by the pressurized fluid in the second half-chamber and by the spring 125 on the piston 103 bring the auxiliary annular element 128 into abutment with the base 109 in the first travel limit position (FIG. 6), in order to change the timing, for example, to advance the opening of the valves, the electronic control unit causes the solenoid valve to move from the second operating position to the first. The second hydraulic circuit is thus connected to the exhaust causing the fluid to flow out of the second half-chamber, whilst pressurized fluid is sent into the first half-chamber through the first hydraulic circuit, the duct 126 and the radial holes 122 in the piston 103. Owing to the pressure of the fluid in the first half-chamber, the piston 103, and hence the auxiliary annular element 128, perform a movement on the straight teeth 121 which brings the auxiliary annular element 128 into abutment with the abutment ring 131 in the second travel limit position. This causes the piston 103 to stop owing to engagement in the teeth 120 and 121 and wedging therein due to the action exerted by the fluid on the piston 103, even when relative rotation between the body 101 and the shaft 102 is prevented. The wedging of the piston 103 enables the meshed teeth to be kept in close contact, eliminating the continuous movement between them.

To return to the initial timing, the electronic control unit causes the solenoid valve to move from the first operating position to the second so that the fluid in the first half-chamber can flow out through the first hydraulic circuit connected to the exhaust whilst pressurized fluid is sent into the second half-chamber through the second hydraulic circuit, the annular duct 117 and the duct 127. The joint action of the pressurized fluid and of the spring 125 on the piston 103 brings about a movement of the piston 103 towards the base 109 on the straight teeth 121 of the shaft 102. This movement brings the auxiliary annular element 128 into abutment with the base 109 in the first travel limit position (FIG. 6), stopping the piston 103 owing to engagement in the teeth 120 and 121.

The mechanical device 100 enables pressurized fluid also to act on the piston during the return movement of the piston from the second travel limit position to the first so as to render this movement faster than if the piston were acted on solely by the force exerted by the spring. Moreover, when the auxiliary annular element 128 is in abutment with the base 109 in its first travel limit position, there is better wedging of the piston 103 in the teeth 120 and 121 since the action exerted by the spring 125 on the piston is added to the action exerted by the pressurized fluid in the second half-chamber.

In the absence of pressurized fluid in both of the hydraulic circuits, for example, in cold starting conditions of the engine, the presence of the spring ensures that the piston stops with wedging in the teeth in the first travel limit position.

Figure 7:
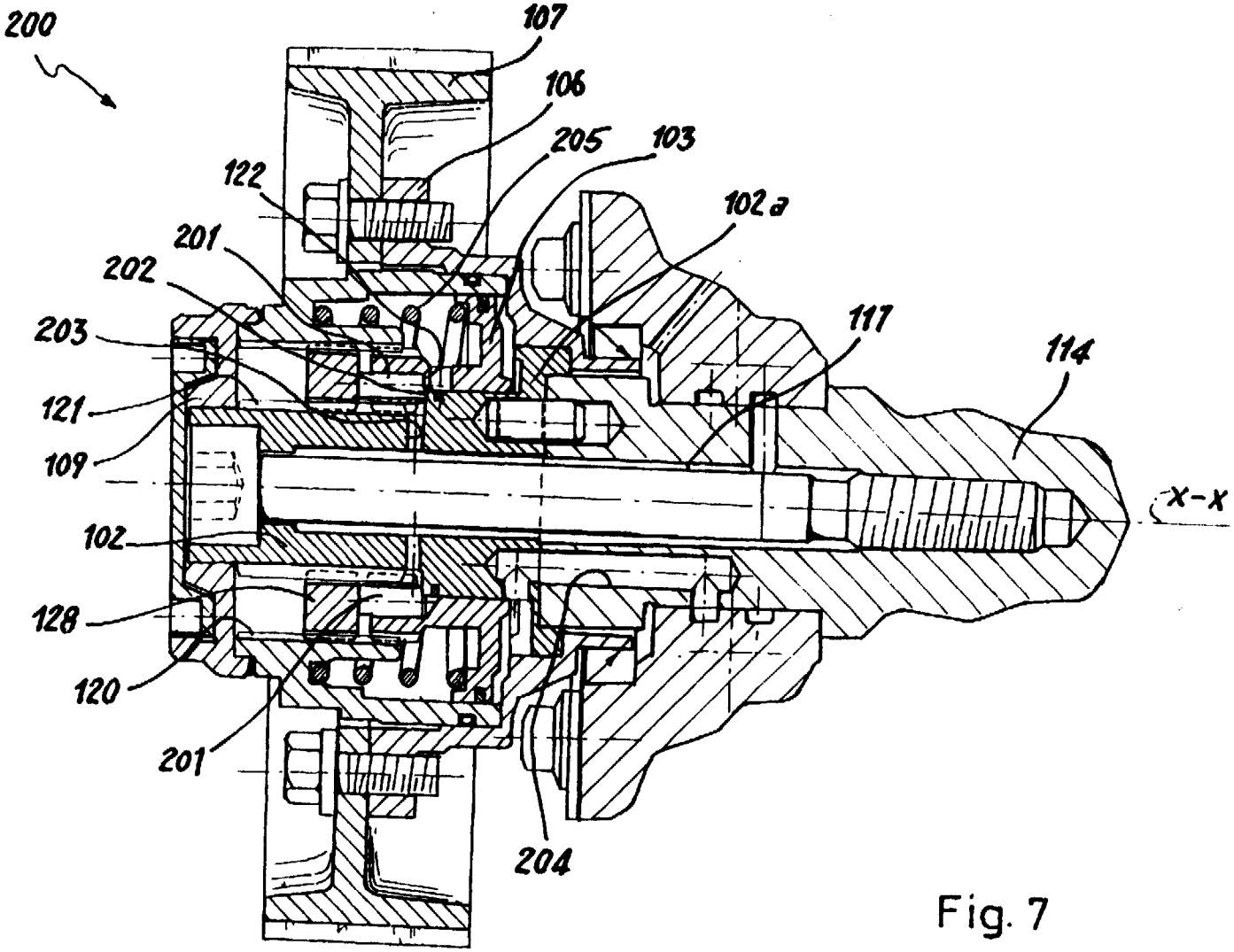

A mechanical device according to the invention, generally indicated 200, is described below with reference to FIG. 7; its parts which are structurally and functionally the same as corresponding parts of the mechanical device 100 are indicated by the same reference numerals and are not described below in order not to lengthen the present description unnecessarily.

In the mechanical device 200, a cylindrical helical spring 205 coaxial with the shaft 102 is housed in the first half-chamber and acts on the head 123 of the piston 103 urging the piston 103 towards the end 102*a* of the shaft 102. The piston 103 is thus partially inserted in the spring 105 so that the axial size of the mechanical device 200 is reduced in comparison with the device 100 described above in which the spring 125 is disposed head to tail with the piston 103 along the axis X—X.

A duct 203 in the shaft 102 puts the first half-chamber into fluid communication, through the holes 122 in the piston 103, with the annular duct 117 which in turn is in fluid communication with the second hydraulic circuit of the camshaft 114.

A further duct 204 formed in the shaft 102 puts the second half-chamber into fluid communication with the first hydraulic circuit of the camshaft 114.

The mechanical device 200 comprises a plurality of pins 201 interposed between the auxiliary annular element 128 and the piston 103 and arranged peripherally at intervals around the shaft 102. The pins 201 are preferably housed in seats formed axially in the piston 103.

The shaft 102 comprises an axial shoulder 202 which limits the axial sliding of the pins 201 towards the end 102*a* of the shaft 102.

When the solenoid valve is in its first operating position, the pressurized fluid flows into the second half-chamber causing a movement of the piston 103 and of the auxiliary annular element 128 towards the base 109, against the action of the spring 205. This movement brings the auxiliary annular element 128 into abutment with the base 109 in a first travel limit position, causing the piston 103 to stop owing to engagement in the teeth 120 and 121. In the first travel limit position, the pins 201 are free to move axially between the piston 103 and the auxiliary annular element 128.

When the solenoid valve is in its second operating position, the pressurized fluid flows into the first half-chamber, causing a movement of the piston 103 and of the auxiliary annular element 128 towards the end 102*a* of the shaft 102. During this movement, the pins 201 are urged by the auxiliary annular element 128 to slide towards the end 102*a* of the shaft 102 until they abut the axial shoulder 202 of the shaft 102 (FIG. 7). This causes the auxiliary annular element 128 to stop against the pins 201 in a second travel limit position, and the piston 103 to stop owing to engagement in the teeth 120 and 121.

In the absence of pressurized fluid in both of the hydraulic circuits, the presence of the spring 205 ensures that the piston 103 stops with wedging in the teeth 120 and 121 in the second travel limit position.

As can be appreciated from the foregoing description, one of the advantages of the mechanical device according to the present invention lies in the fact that it eliminates the continuous movement to and fro between the teeth, mentioned with reference to the prior art, making it noiseless in operation.

Another advantage lies in the fact that, during the movement of the piston and of the auxiliary annular element between the opposite travel limit positions, in comparison with the solution of the prior art referred to in which the teeth remain engaged even during this movement, there is reduced friction between the teeth thus making this movement rapid and reducing the time necessary to change the angular phase relationship between the engine shaft and the camshaft.

Another advantage lies in the fact that the reduced friction between the meshed teeth during the movement of the piston enables the mechanical device according to the present invention to be used even with engines which have little fluid pressure available to operate the device.

A further advantage lies in the fact that the mechanical device according to the present invention is structurally and functionally simple in comparison with the devices of the prior art, resulting in a low production cost and good reliability in operation.

Moreover, the mechanical device according to the present invention is compact.

Naturally, in order to satisfy contingent and specific requirements, an expert in the art may apply to the mechanical device according to the invention described above many modifications and variations all of which, however, are included in the scope of protection of the invention as defined by the following claims.

Thus, for example, the piston and the auxiliary annular element may be coupled to the shaft of the mechanical device by a coupling with helical teeth instead of straight teeth. Moreover, in contrast with those described and illustrated, the piston and the auxiliary annular element may also be coupled to the body by means of straight teeth and to the shaft by means of helical teeth.

The first and second stop abutments may equally well be fixed to one or other of the two components.

I claim:

1. A mechanical device for changing the phase relationship between an engine shaft and a camshaft of an internal combustion engine, of the type comprising a first component and a second component coaxial with one another and adapted to be connected kinematically to the engine shaft and to the camshaft, respectively, and a piston interposed between the components and having two sets of teeth of which one has an angle of twist relative to the other, and which are meshed with a set of teeth of the first component and with a set of teeth of the second component, respectively, the piston moving relative to the components under the action of a pressurized fluid so as to change the relative angular positions of the first component and of the second component and the phase relationship between the engine shaft and the camshaft, comprising an auxiliary annular element interposed between the components at a predetermined distance from the piston and having two sets of teeth meshed with the teeth of the first component and with the teeth of the second component, respectively, and stop means which limit the travel of the auxiliary annular element preventing relative rotation between the components and stopping the piston due to engagement in the teeth of the components.

2. A mechanical device according to claim 1, wherein the stop means comprise a first abutment which defines a first travel limit position of the auxiliary annular element and is fixed to one of the components, and a second abutment which defines a second travel limit position of the auxiliary annular element and is fixed to one or other of the components.

3. A mechanical device according to claim 2, wherein the first abutment comprises a shoulder which is fixed to one of the components and which the auxiliary annular element abuts.

4. A mechanical device according to claim 2, wherein the second abutment is formed by means of an abutment ring which is housed in a seat formed in a set of teeth of one of the components and which the auxiliary annular element abuts.

5. A mechanical device according to claim 2, wherein the second abutment is formed by means of a step which is formed by the removal of a portion of the set of teeth of one of the components, and which interferes with a solid cross-sectioned portion of the set of teeth of the auxiliary element, this solid cross-sectioned portio being slidable in the portion without teeth.

6. A mechanical device according to claim 2, wherein the second abutment is constituted by a step which is formed in the set of teeth of one of the components, and which the auxiliary annular element abuts.

7. A mechanical device according to claim 2, wherein the second abutment is constituted by a step which is formed in the set of teeth of one of the components and with which an abutment ring is urged into abutment by the auxiliary annular element.

8. A mechanical device according to claim 2, wherein the second abutment is constituted by at least one pin disposed between the piston and the auxiliary annular element, the pin being movable between a free position and a position in which it is urged by the auxiliary annular element into abutment with a shoulder fixed to one of the components.

9. A mechanical device according to claim 1, wherein the set of teeth of the first component is helical and the set of teeth of the second component is straight.

10. A mechanical device according to claim 1, wherein the first component is a hollow body and the second component is a hollow shaft supported for rotation in the hollow body.

11. A mechanical device according to claim 10, wherein the hollow body is formed by two half-bodies fixed together by a male/female screw coupling.

12. A mechanical device according to claim 1, further comprising a spring active on the piston in order to keep the piston engaged in the teeth of the components with the auxiliary annular element locked in a travel limit position.

13. A mechanical device according to claim 12, wherein the spring is helical and coaxial with the piston, the piston being at least partially inserted in the spring in which the piston slides during its axial movement.

14. A mechanical device according to claim 12, further comprising a first hydraulic circuit for acting on the piston with the fluid in opposition to the spring and keeping the piston engaged in the teeth of the components with the auxiliary annular element locked in an opposite travel limit position.

15. A mechanical device according to claim 12, further comprising a second hydraulic circuit for acting on the piston with the fluid in cooperation with the spring.

* * * * *